United States Patent [19]

Rieger

[11] Patent Number: 4,729,186

[45] Date of Patent: Mar. 8, 1988

[54] FIREARM WITH BARREL HOLDER FOR INTERCHANGEABLE BARRELS

[75] Inventor: Benedikt Rieger, Altenmünster-Hegnenbach, Fed. Rep. of Germany

[73] Assignee: Dynamit Nobel Aktiengesellschaft, Fed. Rep. of Germany

[21] Appl. No.: 876,392

[22] Filed: Jun. 20, 1986

[30] Foreign Application Priority Data

Jun. 20, 1985 [DE] Fed. Rep. of Germany ..... 3522027

[51] Int. Cl.[4] ..... F41C 21/22

[52] U.S. Cl. ..... 42/75.04; 42/77

[58] Field of Search ..... 42/77, 75.01, 75.02, 42/75.04, 75.03

[56] References Cited

U.S. PATENT DOCUMENTS

| | | | |
|---|---|---|---|
| 624,620 | 5/1899 | Brown | 42/75.04 X |
| 701,159 | 5/1902 | Davenport | 42/75.04 |
| 822,886 | 6/1906 | Elder | 42/75.04 |
| 1,077,103 | 10/1913 | Smith | 42/75.04 X |
| 1,363,262 | 12/1920 | North | 42/75.02 X |
| 1,802,198 | 4/1931 | Cosmi | 42/75.04 X |
| 2,154,517 | 4/1939 | Lewis | 42/75.04 |

FOREIGN PATENT DOCUMENTS

| | | |
|---|---|---|
| 232971 | 10/1909 | Fed. Rep. of Germany . |
| 264479 | 3/1912 | Fed. Rep. of Germany . |
| 1205423 | 9/1963 | Fed. Rep. of Germany . |
| 3228377 | 9/1984 | Fed. Rep. of Germany . |
| 3342059 | 6/1985 | Fed. Rep. of Germany . |
| 339462 | 6/1904 | France . |
| 504747 | 9/1920 | France . |
| 507219 | 5/1923 | France . |
| 1053708 | 2/1954 | France . |
| 1394566 | 2/1965 | France . |

*Primary Examiner*—David H. Brown

*Attorney, Agent, or Firm*—Antonelli, Terry & Wands

[57] ABSTRACT

A firearm including a barrel holder for accommodating interchangeable barrels. A breechblock housing, connected to a stock, includes in a forward zone thereof, a recess having an abutment surface for absorbing recoil forces, with the barrel including a tubular member fixedly connected to a rear end thereof and including an extension fitting into the recess. The tubular member has a relatively large axial length and extends forwardly from a locking mechanism beyond a cartridge chamber of the firearm. The extension is provided at the rear end of the tubular member, and the abutment surface has an undercut portion partially extending over the extension from above. A downwardly projecting second extension is provided at the front end of the tubular member, with the second extension including a locking bolt recess. The breechblock housing extends up to a zone of the second extension and carries, at that location, a locked bolt cooperating with the locked bolt recess.

24 Claims, 4 Drawing Figures

A
16
16b
D2
11
III
35
10
16a
D1
16c
17
6
5
4
II
34
7
24
13
23
3
2
1
14
22
20
12
18
21
19

7
8
25
33
13
24
32
9
1
14
12
21
19
15

FIREARM WITH BARREL HOLDER FOR INTERCHANGEABLE BARRELS

BACKGROUND OF THE INVENTION

The present invention relates to a firearm and, more particularly, to a firearm which includes a barrel holder for accommodating interchangeable barrels wherein a breechblock housing connected to the stock includes, at a forward zone or area thereof, a recess with an abutment surface for absorbing recoil forces, with a tubular member, fixedly joined to a rear end of the barrel and encompassing the barrel, which includes a downwardly projecting extension fitting into a recess, and wherein the breechblock housing and the tubular member are detachably connected with each other by a further connecting member, and a chamber of a cylinder breech mechanism engages into a locking mechanism at the end of the barrel.

In a conventional firearm of the aforementioned type with a barrel holder for interchangeable barrels such as, for example, a firearm proposed in Offenlegungsschrift No. 3,248,620, the breechblock housing includes a transverse groove engaged by an extension of the tubular member, with a screw being provided as a further mounting element, which screw is inserted in a transverse bore of the breechblock housing and threaded into a thread provided in the extension. The extension is fixedly clamped by the screw onto a bottom of the groove in a direction perpendicular to an axis of the barrel.

While in the above noted conventional firearm, the connection between the barrel and the breechblock housing can respectively be released and reestablished in a relatively simple manner, a disadvantage of this conventional firearm resides in the fact that, in all situations, the release and reconnection between the barrel and the breechblock can only be effected through the use of a tool, namely, a hexagonal socket wrench. Moreover, the respective loosening and tightening of the screw requires a certain expenditure of time and, if the screw is not very carefully and firmly tightened, the connection between the tubular member and the breechblock housing will loosen after a firing of several rounds or shots from the firearm.

Further disadvantages of the conventional construction reside in the fact that the screw and/or wrench may easily be lost. Additionally, due to the fact that all connecting parts between the tubular member and the breechblock housing, that is, the extension, the groove, and the screw, interlock at the same location along a relatively short axial length, the thus-established connection between the respective parts is not especially rugged.

The aim underlying the present invention essentially resides in providing a firearm with a barrel holder for interchangeable barrels of the aforementioned type wherein a connection between the tubular member and the breechblock housing can respectively be rapidly released and reestablished in an especially rugged and exact fashion without employing any type of tool and without any danger of loosing any connecting elements.

In accordance with the present invention, a firearm with a barrel holder for interchangeable barrels is provided wherein a tubular member has a relatively long or large axial length and extends from a locking mechanism toward the front of the firearm to a position beyond the cartridge chamber, with an extension being provided at a rear end of the tubular member. An abutment surface is provided which includes an undercut portion extending over the extension at least partially from above, with a downwardly projecting second extension being arranged at the forward end of the tubular member, which second extension includes a lock recess. The breechblock housing is extended up into a zone or area of the second extension and, at that location, carries a lock bolt cooperating with the lock recess.

By virtue of the above-noted features of the present invention, it is possible to effect rapid release and reconnection of the barrel without the utilization of any type of special tool. More particularly, for releasing the barrel, the lock bolt is merely urged from a blocking or locking position into a released position, whereupon the forward portion of the barrel can be swung or pivoted upwardly with respect to the breechblock housing and the stock of the firearm. After a pivoting angle of about 20°-30°, the rearward extension can be pulled out of the associated recess in the direction of the barrel axis. Consequently, for assembly purposes, the rearward extension is inserted in the recess so that the rear end of the extension contacts with the abutment surface of the recess. The forward end of the barrel is, at this point, swung downwardly by about 20°-30°, with respect to the breechblock housing and the stock, during which action or step the forward extension comes into a range of the lock bolt. It is then merely necessary to press the lock bolt into its locking position, or a spring-loaded lock bolt automatically engages into the lock recess of the forward extension and, consequently, the assembly is thus completed.

Since, in accordance with the present invention, all connecting elements are respectively fixedly connected to the barrel and to the breechblock housing, and since there is no need for any special tool, as can readily be appreciated, there is no danger of loss of any parts required for removing and/or reestablishing the connection. Moreover, the rapid assembly and disassembly afforded by the present invention not only makes it possible to exchange one barrel against a barrel of a different caliber, but also facilitates a separation of the barrel from the breechblock housing and the remainder of the stock for purposes of, for example, shipping, storing, and cleaning.

Additionally, since, in accordance with the present invention, the tubular member exhibits a relatively long axial length and is provided at both ends thereof with extensions serving for connection to the breechblock housing, a very rugged and exact connection is created between the barrel and the breechblock housing, thereby ensuring a high firing accuracy even immediately after connecting the two components.

Furthermore, with the large axial spacing of the two extensions and of the parts of the breechblock housing cooperating therewith, by virtue of the present invention, it is possible to impart to the barrel the maximum possible directional stability. Also, the relatively long tubular member affords the mounting of a relatively long receiving prism so as to enable the mounting of a scope sight thereof, thereby rendering the firearm of the present invention capable of accommodating scope sights of various makes and of a great variety of lengths. Additionally, the telescopic sight can remain connected to the barrel while detaching the barrel from the breechblock housing.

Advantageously, according to the present invention, the barrel comprises, a rear barrel end thereof, a breech head integrally formed with the barrel and comprising several radially inwardly projecting locking projections cooperating with the cartridge chamber and the barrel includes, forwardly of the breech head, in a forward zone of the cartridge chamber, a smaller diameter than the breech head. The barrel is inserted from the rear in a longitudinal bore of the tubular member with a section thereof, smaller in diameter, and is soldered or glued to the tubular member. The construction of the present invention simplifies the manufacturing of the barrel in the tubular member, for the barrel is essentially only a turned part. The tubular member can be manufactured as a precision casting not requiring any refinishing since, in the arrangement of the present invention, it does not constitute a part of the cylinder breech mechanism. Also, in this case, the tubular member can be connected with barrels of differing calibers. The barrel may have a relatively small diameter in a region forwardly of the breech head so that the tubular member becomes smaller in its outer diameter and the total weight of the firearm is reduced.

The above and other objects, features, and advantages of the present invention will become more apparent from the following description when taken in connection with the accompanying drawings which show, for the purpose of illustration only, several embodiments in accordance with the present invention.

DETAILED DESCRIPTION

Figure 1:
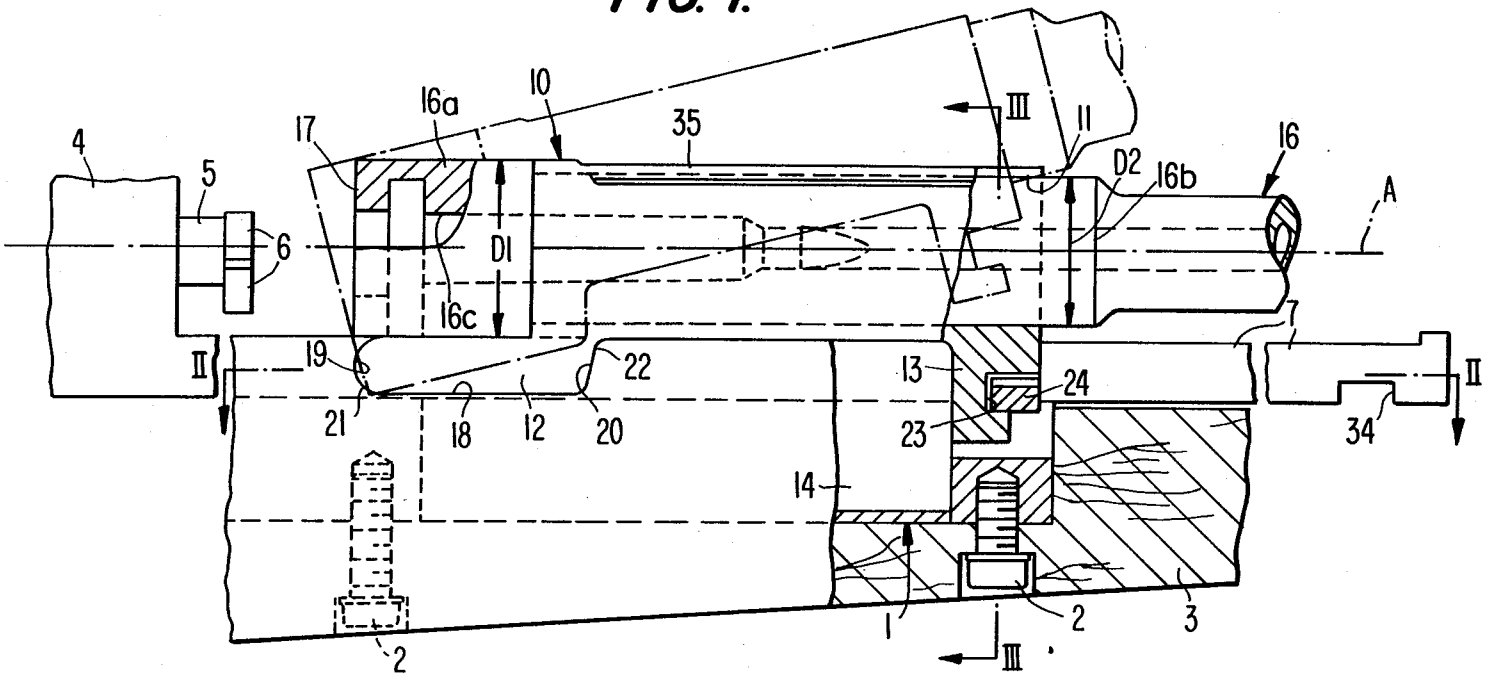
FIG. 1 is a partial cross-sectional lateral view of a first embodiment of a firearm constructed in accordance with the present invention.
Figure 2:
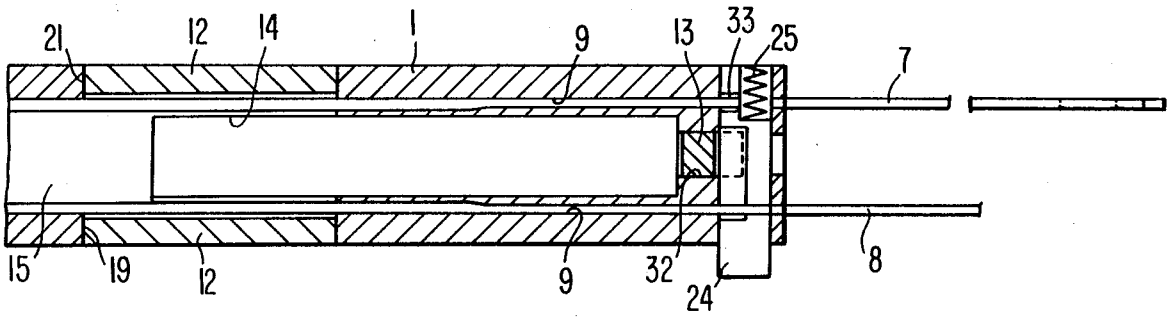
FIG. 2 is a longitudinal cross-sectional view taken along the line II—II in FIG. 1.

Referring now to the drawings wherein like reference numerals are used throughout the various views to designate like parts and, more particularly, to FIGS. 1 and 2, a firearm includes a breechblock housing 1 connected with a stock 3 by fasteners such as, for example, screws 2. A housing portion 4 carries a breech bolt 5, with the locking projections 6 being guided so as to be displaceable in a direction of a barrel axis A of the breechblock housing 1. For this purpose, the housing portion 4 includes two guide strips 7, 8 displaceable in two upwardly open guide grooves 9 of the breechblock housing 1.

A tubular member generally designated by the reference numeral 10 is provided which includes a longitudinal bore 11, with the tubular member 10 having, at a rear end thereof, a first extension 12 and, at a front end thereof, a second extension 13. To provide space for a magazine well 14 and to enable a removal of cartridges (not shown) from the magazine well 14, the first extension 12 includes a recess 15 extending in a direction of the barrel axis A, with the two guide rails 7, 8 also extending through the recess 15. The barrel 16 has, at a rear end thereof, a breech head 16*a* formed integrally therewith, that is, formed in one piece with the barrel 16, with the breech head 16*a* being provided with several radially inwardly projecting locking projections 17. The locking projections 17 cooperate with locking nubs 6 of the breech bolt 5 in a manner of a bayonet-type catch.

Forwardly of the breech head 16*a*, the barrel 16 exhibits, in a zone of the cartridge chamber, a cylindrical part 16*b*, a diameter D2 which is less than a diameter D1 of the breech head 16*a*. The barrel 16 is inserted from the rear in the longitudinal bore 11 and is suitably soldered or, optionally, secured by an appropriate adhesive such as, for example, glue, to the tubular member 10, in the latter situation, for safety reasons, a cross pin (not shown) may be provided for engaging, at least in part, in the tubular member 10, and, at least in part, in the member 16*b* of the barrel 16.

In an axial direction, the tubular member 10 has a relatively long or large length L which is at least three times as long as the diameter D2 of the barrel portion 16*b* encompassed or surrounded by the tubular member 10. The extension 12 extends from the tubular member 10 downwardly and rearwardly up to a rearward end of the breech head 16*a*.

The breechblock housing 1 is provided with a recess 18 that is continuous in the transverse direction and is open in the upward direction, with the first extension 12 fittingly engaging in the recess 18. The recess 18 has, at a rear thereof, an abutment surface 19 and, at a front thereof, a counter surface 20 disposed or lying in opposition to the abutment surface 19 and oriented obliquely toward the front in an upward direction. The abutment surface 19 includes an undercut portion partially extending over the rearward supporting area 21 of the extension 18. Forwardly or at the front, the extension 12 rests, with a forward supporting surface 22, on the counter surface 20, with a spacing between the two supporting surfaces 21, 22 being dimensioned so that the extension 12 fits into the recess 18 with a clamping action.

The abutment surface 19, as shown in FIG. 1, is suitably curved in a concave fashion in the shape of a semicircle, and the rearward supporting surface 21 is curved, in a matching or fitting configuration, convexly in the shape of a semicircle. The abutment surface 19 then serves as a bearing socket during a pivoting of the barrel 16 with respect to the breechblock housing 1.

Figure 4:
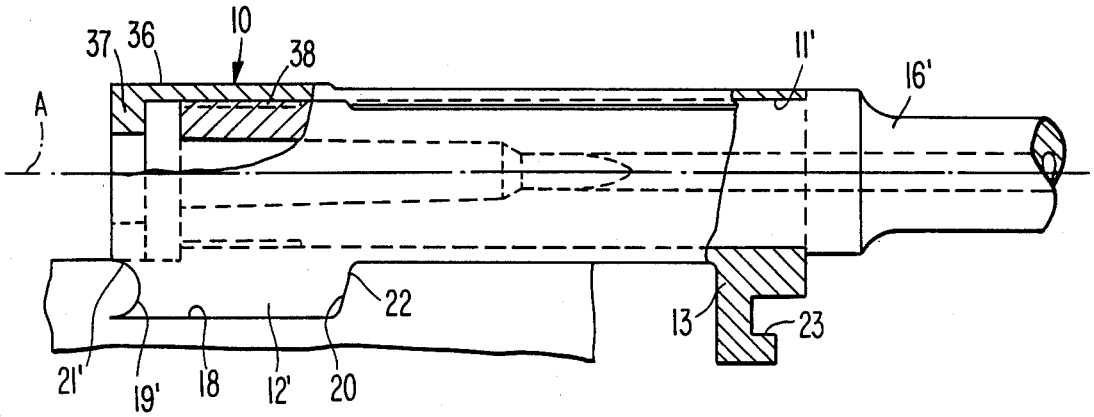
FIG. 4 is a partial longitudinal cross-sectional view of another embodiment of a firearm constructed in accordance with the present invention.

As shown most clearly in FIG. 4, the above described constructional arrangement could also be affected in a reverse manner whereby the abutment surface 19′ is curved convexly in the shape of a semicircle, and the supporting surface 21′ is fashioned, in a corresponding or fitting fashion, to be concave in a semicircular shape.

The downwardly projecting extension 13, provided at the front end of the tubular member 10 includes a lock recess 23 accommodating an cooperating with a lock bolt 24, with the lock bolt 24 being displaceable in the breechblock housing 1 in a direction transverse to the barrel axis A. The lock bolt 24 is suitably urged into the locked position by, for example, a spring 25. In order to ensure that the lock bolt 24, during a pivoting of the barrel 16, is automatically biased or urged to the side by the extension 13, as shown in FIG. 3, the extension 13 has an inclined surface 26, and the lock bolt 24 has a cooperating inclined surface 27.

The tubular member 10 is provided with a planar bottom surface 28 contacting an upper abutment surface 29 of the breechblock housing 1. In order to maintain both the planar bottom surface 28 and the upper abutment surface 29 in contact with each other without any play, the lock bolt 24 includes a wedge surface 30 which is slightly inclined with respect to a displacement direction B thereof, with the wedge surface 30 cooperating with a correspondingly inclined wedge surface 31 of the lock recess 23 of the extension 13. The wedge surfaces 30, 31 are inclined at an angle of about 3° with respect to the displacement direction B of the lock bolt 24.

In order to ensure a secure guidance of the second extension 13 in a direction transverse to the barrel axis A with respect to the breechblock housing 1, the breechblock housing 1 has, in a zone or area of the second extension 13, a recess 32 extending in the direction of the barrel axis A, with lateral faces of the recess 32, extending in the direction of the barrel axis A, contacting the second extension 13 along the sides.

Figure 3:
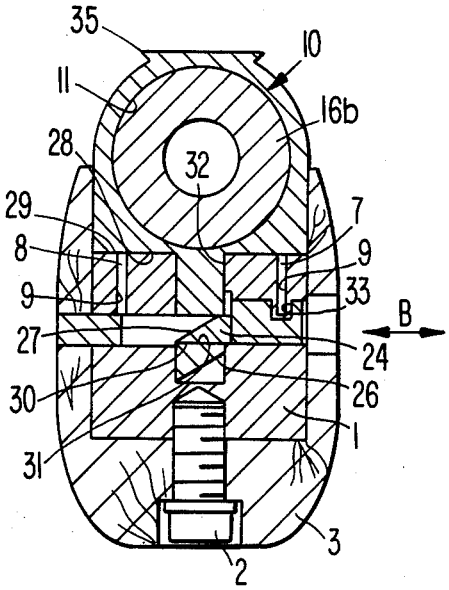
FIG. 3 is a cross-sectional view taken along the line III—III in FIG. 1.

As shown in FIG. 3, the lock bolt 24 includes a groove 33 extending in the direction of the barrel axis A, with the guide strip 7 of the housing portion 4 engaging into the groove 33. In this manner, an unintended shifting of the lock bolt 24, from a locking position illustrated in FIG. 3, is prevented. It is only when the housing portion 4 is completely pulled rearwardly with the breechblock in an open position, a recess 34, provided at the forward end of the guide strips 7, comes to lie in a zone or area of the lock bolt 24. The guide strip 7 is then no longer in engagement with the groove 33, and the lock bolt 24 can be displaced against the spring 25 into an unlocked position.

In the unlocked position, the lock bolt 24 vacates the forward extension 13, and the barrel 16 can be swung or pivoted with its front end above the breechblock housing 1 in an upward direction. The abutment surface 19 serves as a bearing socket for the rearward supporting surface 21 of the extension 12. Once the barrel has been pivoted by about 20°–30° with respect to the breechblock housing 1 upwardly into the position illustrated in phantom lines in FIG. 1, it can be pulled out toward the front in a direction of the barrel axis A, with the extension 12 exiting or leaving the recess 18.

Since the guide grooves in the breechblock housing 1 open toward the top thereof and, after removal of the barrel 16 together with the tubular member 10, are no longer covered by the tubular member 10, the housing portion 4 can now be removed, if necessary, together with the guide strips 7, 8 in an upward direction.

For connecting the barrel 16 to the breechblock housing 1, the barrel 16 is shifted in the position shown in phantom lines in a direction of the barrel axis 1 until the supporting surface 21 of the rearward extension 12 contacts the abutment surface 19. At this point, the barrel 16 is swung downwardly with respect to the breechblock housing 1, with the forward extension 13 entering the recess 32. Shortly before the bottom surface 28 contacts the upper abutment surface 29 of the breechblock housing 1, the forward supporting surface 22 contacts the inclined surface 20 whereby the extension 12 is firmly urged with its rearward supporting surface 21 against the abutment surface 19. Due to the inclined surface 26 at the forward extension 13 and the inclined surface 27 at the lock bolt 24, the lock bolt 24 is forced toward the side against the bias or urging of the spring 25 and then automatically snaps into the locking position of FIG. 3 as soon as the bottom surface 28 contacts the abutment surface 29. The lock bolt 24 does not permit the cylinder breech mechanism to function if the barrel 16 has not been correctly inserted. Only once the lock bolt 24 has once again reached the locking position of FIG. 3 does the groove 33 re-enter the displacement zone of the guide strip 7, and only then can the housing 4 of the cylinder breech mechanism can once again be forwardly displaced. Therefore, the barrel change can only be carried out with the breech mechanism in an open position, and it is ensured that the barrel 16, during a firing of the firearm, is positioned in an exact and precise manner firmly connected to the breechblock housing 1, and such connection cannot be inadvertently released.

Moreover, the tubular member 10 may be provided, in an upper region thereof, with a receiving prism-shaped formation 35 for enabling a mounting of a telescopic sight (not shown).

It is to be noted that another advantage of the construction according to the present invention resides in the fact that the connecting elements are provided only between the breechblock housing 1 and the tubular member 10 and, consequently, no transverse stresses are exerted on the barrel 16 by the connecting and mounting components or parts. Since the transverse stresses act only on the tubular member 10 rather than on any ballistic elements, the target accuracy of the firearm cannot be impaired in any manner.

In FIG. 4, a tubular member 10' includes, at a rear end thereof, a breech head 36 with a plurality of radially inwardly projecting locking elements 37 cooperating with the cartridge chamber. A barrel 16' is inserted from the front into a longitudinal bore 11' of the tubular member 10' and can either be soldered in place or connected to the tubular member 10' by, for example, a thread 38. The connecting parts for joining with the breechblock housing 10 are of identical construction as in the previously described embodiment so that their description need not be further described.

While I have shown and described several embodiments in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A firearm comprising a barrel holder means for accommodating interchangeable barrels, a breechblock housing means connected to a stock, said breechblock housing means including in a forward zone thereof a recess means provided with an abutment surface means for absorbing recoil forces; a tubular member fixedly joined to a rear end of an interchangeable barrel and encompassing the barrel, said tubular member including a downwardly projecting extension fitting into said recess means; and a breech bolt of a cylinder breech mechanism engages into a locking mechanism at the barrel end, and wherein:

the tubular member has a relatively large axial length and extends from the locking mechanism toward a front of the firearm to a position beyond a cartridge chamber, the downwardly projecting extension is provided at a rear end of the tubular member, the abutment surface means includes an undercut portion extending over the downwardly projecting extension at least partially from above, a second downwardly projecting extension is arranged at a forward end of the tubular member and includes a locking recess means, and the breechblock housing means is extended up to a zone of the second downwardly projecting extension and, that location, carries a lock bolt means cooperable with the locking recess means whereby said breechblock housing means and said tubular member are detachably connectable to each other.

2. A firearm according to claim 1, wherein a housing portion of the firearm includes guide strips displaceable in upwardly open guide groove means of the breechblock housing means, and wherein the guide groove means are covered by a bottom surface of the tubular member.

3. A firearm according to claim 1, wherein an axial length of the tubular member is at least three times as large as a diameter of the barrel encompassed by the tubular member.

4. A firearm according to claim 1, wherein the first downwardly projecting extension includes a recess extending in a direction of the barrel axis, and wherein a magazine well is arranged in said last-mentioned recess.

5. A firearm according to claim 1, wherein the lock bolt means is displaceable in a direction transverse to the barrel axis.

6. A firearm according to claim 1, the second downwardly extending projection includes, at a bottom thereof, an inclined surface, and the lock bolt means includes, at a top thereof, an inclined surface, and wherein spring means are provided for urging the lock bolt means into a locking position.

7. A firearm according to claim 1, wherein the locking bolt means includes a groove means extending in a direction of the barrel axis, the housing portion includes a plurality of guide strips, one of said guide strips carrying the breech bolt of the cylinder breech mechanism and engaging into said groove means.

8. A firearm according to claim 1, wherein the lock bolt means and the lock recess means include a plurality of wedge surface means which are slightly inclined with respect to a displacement direction of the lock bolt means and are in contact with each other in a locking position.

9. A firearm according to claim 8, wherein the wedge surface means are inclined at an angle of about 3° with respect to a displacement direction of the lock bolt means.

10. A firearm according to claim 1 wherein the recess means includes at a front end thereof, a counter surface means and, at a rear end thereof, an abutment surface means, said counter surface means being oriented obliquely toward the front in an upward direction; and wherein the first extension includes a rearward supporting surface means in contact with the abutment surface means and a forward supporting surface means in contact with the counter surface means, a spacing between the forward and rearward supporting surface means being dimensioned such that the first extension, after a front end thereof has been swung inwardly, fits with a slight clamping seat into the recess means.

11. A firearm according to claim 1, characterized in that the abutment surface means is curved concavely in a semicircle, and the rearward supporting surface means is curved fittingly therewith convexly in a semicircle.

12. A firearm according to claim 10, characterized in that the abutment surface means is curved convexly in a semicircular shape, and the rearward supporting surface means is curved fittingly therewith concavely in a semicircular shape.

13. A firearm according to claim 1, wherein a breech head is integrally formed with the barrel at a rear end thereof, said locking mechanism includes a plurality of radially inwardly projecting locking means provided on said breech head and cooperating with the breech bolt of the cylinder breech mechanism; the barrel has, forwardly of the breech head in a forward zone of the cartridge chamber, a diameter smaller than a diameter of the breech head; and wherein the barrel is inserted from a rear in a longitudinal bore of the tubular member with the smaller diameter portion and affixed to the tubular member by at least one of solder or an adhesive.

14. A firearm according to claim 13, wherein the axial length of the tubular member is at least three times as large as the diameter of the barrel encompassed by the tubular member.

15. A firearm according to claim 13, wherein the recess means includes at a front end thereof, a counter surface means and, at a rear end thereof, an abutment surface means, said counter surface means being oriented obliquely toward the front in an upward direction; and wherein the first extension includes a rearward supporting surface means in contact with the abutment surface means and a forward supporting surface means in contact with the counter surface means, a spacing between the forward and rearward supporting surface means being dimensioned such that the first extension, after a front end thereof has been swung inwardly, fits with a slight clamping seat into the recess means.

16. A firearm according to claim 15, characterized in that the abutment surface means is curved concavely in a semicircle, and the rearward supporting surface means is curved fittingly therewith convexly in a semicircle.

17. A firearm according to claim 15, characterized in that the abutment surface means is curved convexly in a semicircular shape, and the rearward supporting surface means is curved fittingly therewith concavely in a semicircular shape.

18. A firearm according to claim 15, wherein the first downwardly projecting extension includes a recess extending in a direction of the barrel axis, and wherein a magazine well is arranged in said last-mentioned recess.

19. A firearm according to claim 1, wherein the breechblock housing means includes, in a zone of the second downwardly projecting extension, a recess means extending in the direction of the barrel axis, and wherein lateral surfaces of said last-mentioned recess means, extending in the direction of the barrel axis, laterally come into contact with the second downwardly projecting extension.

20. A firearm according to claim 19, wherein the lock bolt means is displaceable in a direction transverse to the barrel axis.

21. A firearm according to claim 20, wherein the second downwardly extending projection includes, at a bottom thereof, an inclined surface, and the lock bolt means includes, at a top thereof, an inclined surface, and wherein spring means are provided for urging the lock bolt means into a locking position.

22. A firearm according to claim 21, wherein the locking bolt means includes a groove means extending in a direction of the barrel axis, the housing portion includes a plurality of guide strips, one of said guide strips carrying the breech bolt of the cylinder breech mechanism and engaging into said groove means.

23. A firearm according to claim 22, wherein the lock bolt means and the lock recess means include a plurality of wedge surface means which are slightly inclined with respect to a displacement direction of the lock bolt means and are in contact with each other in a locking position.

24. A firearm according to claim 23, wherein the wedge surface means are inclined at an angle of about 3° with respect to a displacement direction of the lock bolt means.

* * * * *